US007645962B2

(12) United States Patent
Krossa et al.

(10) Patent No.: US 7,645,962 B2
(45) Date of Patent: Jan. 12, 2010

(54) PORTABLE GROUNDING MAT WITH IMPROVED TERMINAL

(76) Inventors: Dean Loy Krossa, 150 Logan Close, Red Deer, AB (CA) T4R 2N9; Theodore David Krossa, 94 Lund Close, Red Deer, AB (CA) T4R 2T1

( * ) Notice: Subject to any disclaimer, the term of this patent is extended or adjusted under 35 U.S.C. 154(b) by 0 days.

(21) Appl. No.: 11/277,346

(22) Filed: Mar. 23, 2006

(65) Prior Publication Data

US 2007/0221660 A1 Sep. 27, 2007

(51) Int. Cl.
*H05B 3/08* (2006.01)
*H01R 4/66* (2006.01)

(52) U.S. Cl. ..... 219/541; 439/92

(58) Field of Classification Search ..... 219/541, 219/538; 361/220; 338/322; 439/135, 139, 439/137, 92

See application file for complete search history.

(56) References Cited

U.S. PATENT DOCUMENTS

| | | | | |
|---|---|---|---|---|
| 4,631,391 | A * | 12/1986 | Tiepke | 219/541 |
| 4,837,925 | A * | 6/1989 | Gellert | 29/619 |
| 5,835,332 | A | 11/1998 | White et al. | |
| 6,477,027 | B1 * | 11/2002 | McKelvy | 361/220 |
| 7,104,706 | B2 * | 9/2006 | Bergstrsom et al. | 385/99 |

* cited by examiner

*Primary Examiner*—Daniel L Robinson
(74) *Attorney, Agent, or Firm*—Thomas E. Malyszko

(57) ABSTRACT

This invention relates to a portable grounding mat, and more particularly to a mat specifically designed to protect electrical workers by providing a zone of equi-potential. The mat has a flexible base to which is attached at least one conductive element laid out in a grid pattern. A novel terminal that electrically connects the mat to a power source has an inner core to provide an electrical load path and an outer casing to provide a mechanical load path, resulting in a superior mat design.

11 Claims, 5 Drawing Sheets

* TEST SUSPENDED PRIOR TO FAILURE

PORTABLE GROUNDING MAT WITH IMPROVED TERMINAL

FIELD OF THE INVENTION

The present invention relates to a portable grounding mat for providing a zone of equi-potential to protect electrical workers who are in contact with the ground, and in particular relates to an improved electrical terminal for such a mat.

BACKGROUND OF THE INVENTION

Electrical terminals for existing grounding mats have certain drawbacks, and have proved to be a weak point of the mat designs. The terminals typically comprise lengths of flat braid wire protruding from one or more corners of the mat (as shown in FIGS. 1&2), and serves as an electrical load path between the mat and the power source being serviced by the user. However, users have a tendency to grip the terminals by hand to lift, move and position the mat. Unfortunately, such handling induces strains in the terminal, subjecting the flat braid wire to bending, such as by twisting and rolling motions, and tensile forces. Hence, the wire also serves as the conduit for such forces, or "loads", to and from the mat, referred to herein as the "mechanical load path".

Repeated handling has shown to lead to failure of the terminal. This can be catastrophic for the user, as a break in the terminal during use of the mat will extinguish the zone of equi-potential, and thus the protection afforded by the mat, resulting in the possible electrocution and potential death of the user.

What is therefore desired is a novel terminal design for a grounding mat which overcomes the limitations and disadvantages of the existing terminals. Preferably, it should provide for greater structural strength of the terminal and prolong its working life. The terminal should provide substantially separate paths for electrical loads and mechanical loads.

SUMMARY OF THE PRESENT INVENTION

According to the present invention, there is provided in one aspect a terminal for a portable grounding mat to protect a worker servicing a power source and having at least one conductive element extending thereover forming a grid, the terminal comprising a first portion for providing an electrical load path between the grid and the power source to form a zone of equi-potential and a second portion for providing a mechanical load path between the terminal and the mat.

In another aspect the invention provides a portable grounding mat to protect a worker working on a power source, the mat comprising:

a base of flexible material having at least one conductive element attached to a surface of the base and extending thereover in a grid pattern; and, a terminal having an inner core for electrical communication between the conductive element and the power source to provide a zone of equi-potential to the worker on the base and an outer casing for transferring mechanical load between the terminal and the base.

BRIEF DESCRIPTION OF THE DRAWING FIGURES

Embodiments of the invention will now be described, by way of example only, with reference to the accompanying drawings, wherein.

DESCRIPTION OF PREFERRED EMBODIMENTS

Figure 1:
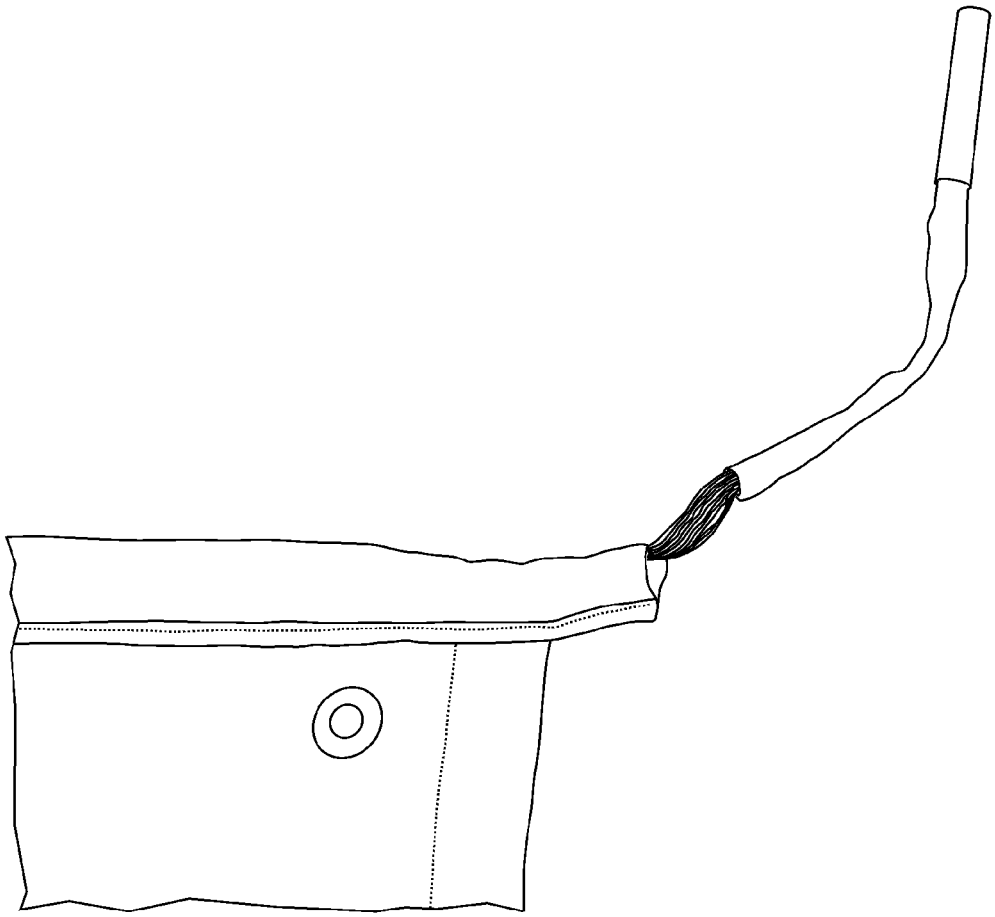
FIG. 1 (PRIOR ART)
FIG. 1 shows a prior art terminal and grounding mat.
Figure 2:
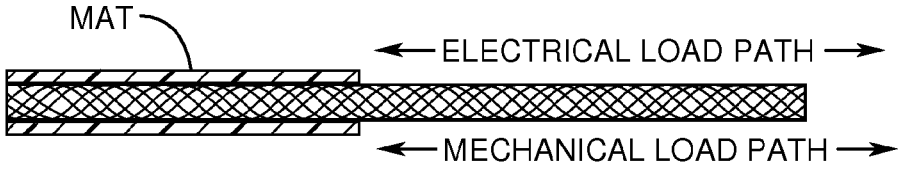
FIG. 2 (PRIOR ART)
FIG. 2 is a cross-sectional view along the terminal of FIG. 1 at its juncture with the mat.
Figure 3:
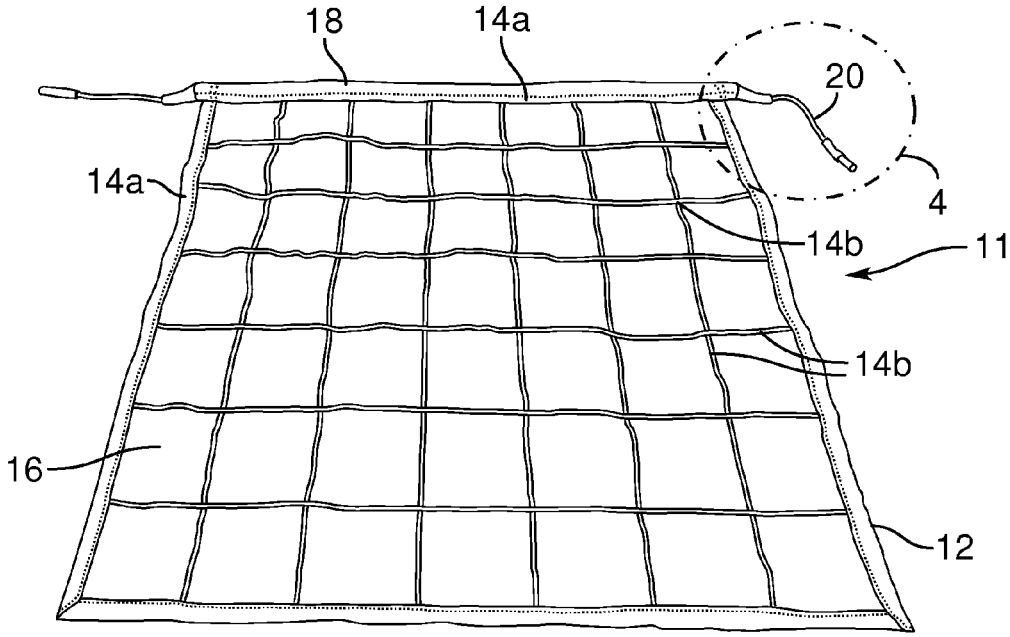
FIG. 3 is a plan view of a grounding mat and terminal according to a preferred embodiment of the present invention showing an optional second terminal at an opposed end of the grounding mat.
Figure 4:
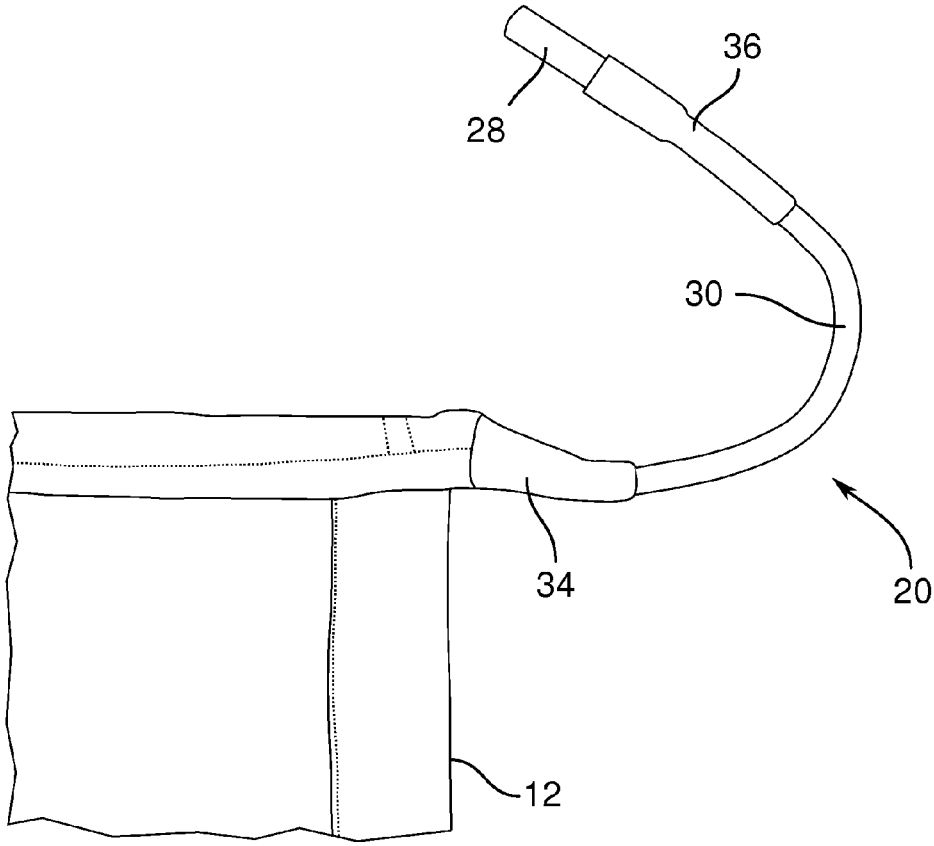
FIG. 4 is a close-up view of the mat and terminal in the circled portion of FIG. 3 indicated by reference numeral 4.
Figure 5:
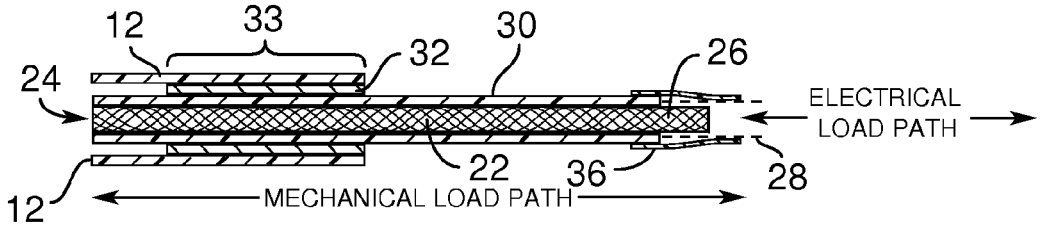
FIG. 5 is a cross-sectional view along the terminal of FIG. 4 at its juncture with the mat.

FIGS. 3 to 5 show a grounding mat (generally designated by reference numeral 10) with an improved terminal 20 according to a preferred embodiment of the present invention. The design and construction of the mat base, or body, 12 is relatively simple. One or more continuous conductive elements, preferably high ampacity tinned copper braid 14, are attached to one side or surface 16 of the base 12 to form a grid pattern substantially covering the mat. The braid or braids are provided around and adjacent each edge or periphery of the base (as at 14*a*) and in a cross-over grid pattern covering the central area of the base (as at 14*b*). For ease of description, it will be assumed that the grid pattern is formed by multiple overlapping braids. In constructing the mat, each edge of the base is folded inwardly over each corresponding peripheral braid 14*a* and attached, as by sewing, to the base to enclose the braid therewithin and provide a more durable mat periphery. This grid pattern of overlapping braids 14 ensures that any break in one portion of a braid in a given grid area will not affect other areas of the grid, and thus the mat would continue to provide a zone of equi-potential.

The base material is preferably a vinyl/polyester fabric or like flexible conductive or non-conductive material, and each braid is attached to the base by suitable means, preferably by sewing.

All braids 14 are connected to the same power source (not shown) via a terminal 20 to ensure that the mat is of one potential. The mat's terminal 20 is an important aspect of the present invention. With reference to FIGS. 4 and 5, the terminal extending from a corner of the mat has a first portion defining an elongate inner core 22 having a first, inner, end 24 for electrical communication (i.e. transmission) with the braids of the mat by appropriate connection therebetween. The core 22 provides a suitable electrical load path between the mat 10 and the power source, whether linked directly to the power source or through one or more like mats. In the preferred embodiment the core 22 is of the same material and structure as each braid 14 for ease of manufacture. However, it will be appreciated that the inner core may be made of other suitable high ampacity electrically conductive materials and of different dimension than the braids 14 to provide the desired electrical load path. The distal end 26 of the core is fitted with a male or female connector 28 (shown in FIG. 4, and in dotted outline in FIG. 5) for electrical connection to the power source or to an adjacent mat.

The terminal 20 has a second portion defining an outer sheath or casing 30 which functions as the "mechanical load path", namely its purpose is to transfer bending and tensile forces between the terminal and the mat body 12, and to reduce or eliminate the transfer of such forces, or "mechanical loads", through the core. The mechanical load transfer is pronounced at or near the terminal and mat body interface, arising mostly when the terminal is gripped by a user to move the mat. In the preferred embodiment the casing completely surrounds, or "encases", the core circumferentially and extends longitudinally toward the inner and distal ends 24, 26 of the core to provide uniform load transfer regardless about which axis the terminal is bent, and to protect the core from the elements. However, it will be appreciated that the casing may also take other "discontinuous" forms, such as a mesh for instance, although this is not preferred as it will not fully shield the core and may be uncomfortable to hold. The casing may be either a flexible or rigid material of a conductive, semi-conductive or insulating nature capable of providing the desired mechanical load path between the terminal and mat. The casing 30 is secured to the mat fabric 12 to transfer the mechanical loads therebetween and away from the electrical load path, such as by means of a physical or chemical connection 32 (e.g. a clamp or glue, respectively). To obtain the desired connection, particularly with a bonding agent, an adequate bonding area or zone 33 should be provided by overlapping the casing within the mat 12.

Optionally, the connection 32 may be fortified by providing a contiguous sleeve 34 that extends from the edge of the mat onto the terminal casing 30, such as the heat shrink sleeve shown in FIG. 4. The sleeve 34 should be secured to the mat edge to enhance mechanical load transfer between the mat and terminal, and need not be of the same material as the connection 32. It will be appreciated that the sleeve may take the form of other load transfer means between the mat fabric and the casing, such as mechanical devices in the form of tie straps or cable ties. A tubular shield 36 may also be optionally located over the interface between the distal end of the casing 30 and the connector 28 to carry the mechanical load while not jepordizing the electrical load path.

Figure 6:
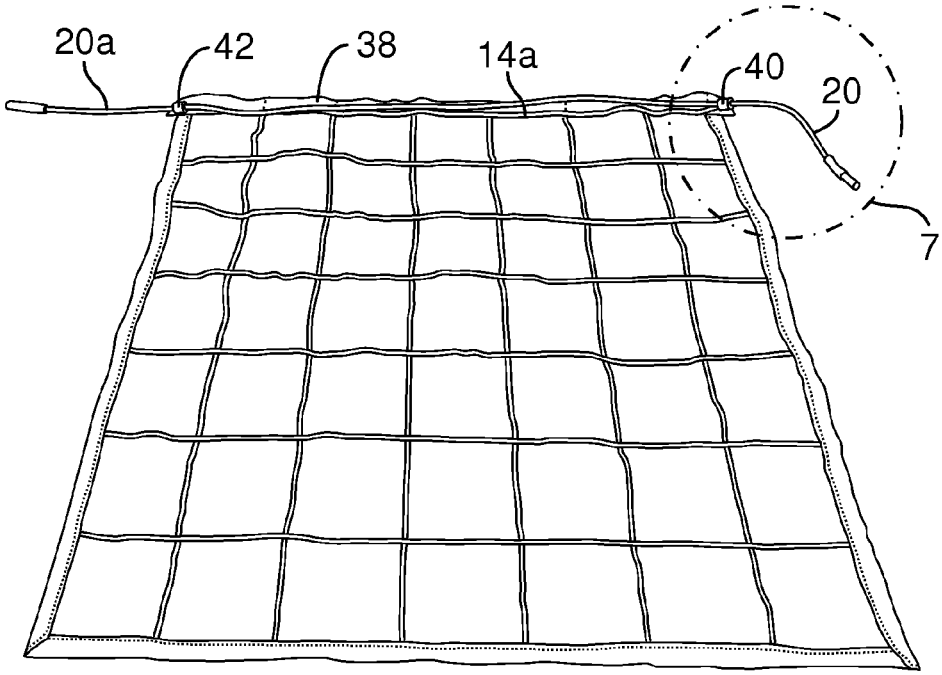
FIG. 6 is a plan view of a grounding mat and terminal according to an alternate embodiment of the present invention, with a top edge of the mat unfolded showing a terminal link traversing along that edge between two terminals at opposed ends of the mat.

More than one terminal 20 may be provided on any one mat, such as the second terminal 20*a* shown in FIG. 6 at a corner of the mat at an opposed end from the first terminal 20. Alternately, the second terminal 20*a* may be located at the corner diagonally opposite from the first terminal 20, and additional terminals may be located at the other corners of the mat. Although it is preferable to locate any given terminal at a corner for ease of assembly, it will be understood that it can also be located along the edge of the mat away from the corners, if need be. The additional terminal(s) may be used to electrically link two or more mats adjacent one another to form a larger zone of equipotential.

Figure 7:
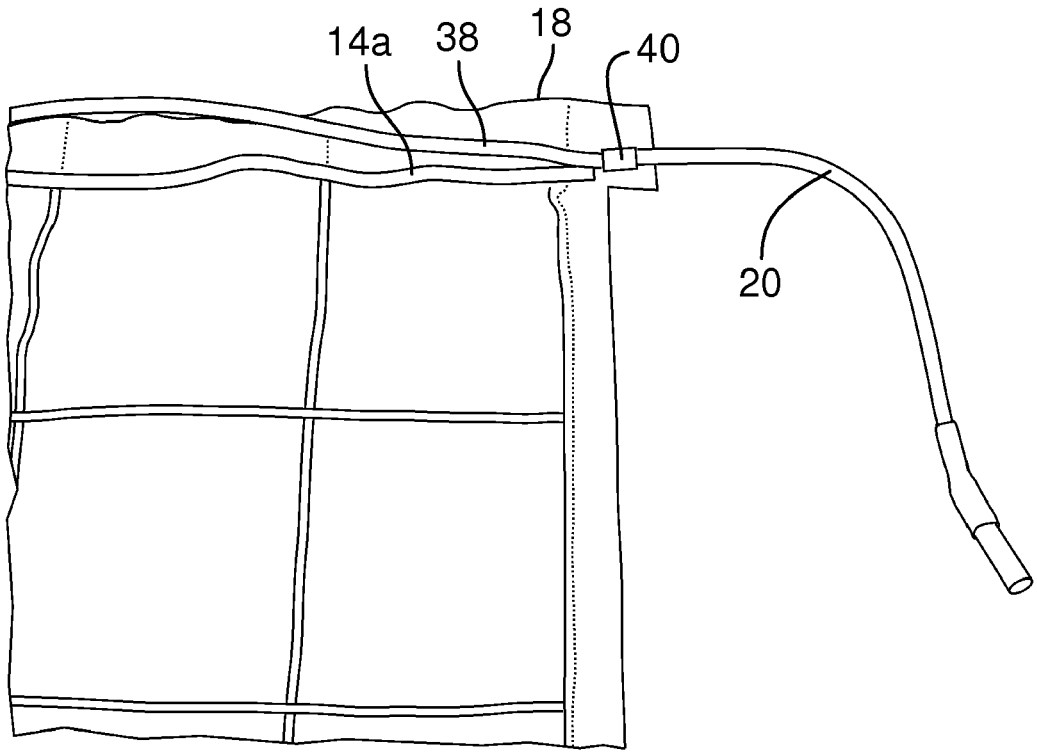
FIG. 7 is a close-up view of the mat and terminal in the circled portion of FIG. 6 indicated by reference numeral 7.

FIGS. 6 and 7 also show an alternate embodiment of the invention where the opposed terminals 20 and 20*a* are joined by an extension, or link, 38 which is of the same or similar construction as the terminals, namely a core wrapped in an outer casing. The link 38 extends parallel to the peripheral braid 14*a* and the top edge 18 of the mat. One end of the link 38 and the terminal 20 are both joined to the electrical mat's grid (including the peripheral braid 14*a*) by an electrically conductive collar 40 that penetrates the casing to the core. A like second collar 42 at the opposed corner of the mat joins the other end of the link 38 and the second terminal 20*a* to the mat grid. Hence, the terminals 20 and 20*a* not only communicate electrically through the peripheral braid 14*a* and the grid, but in parallel through the link 38.

Figure 8:
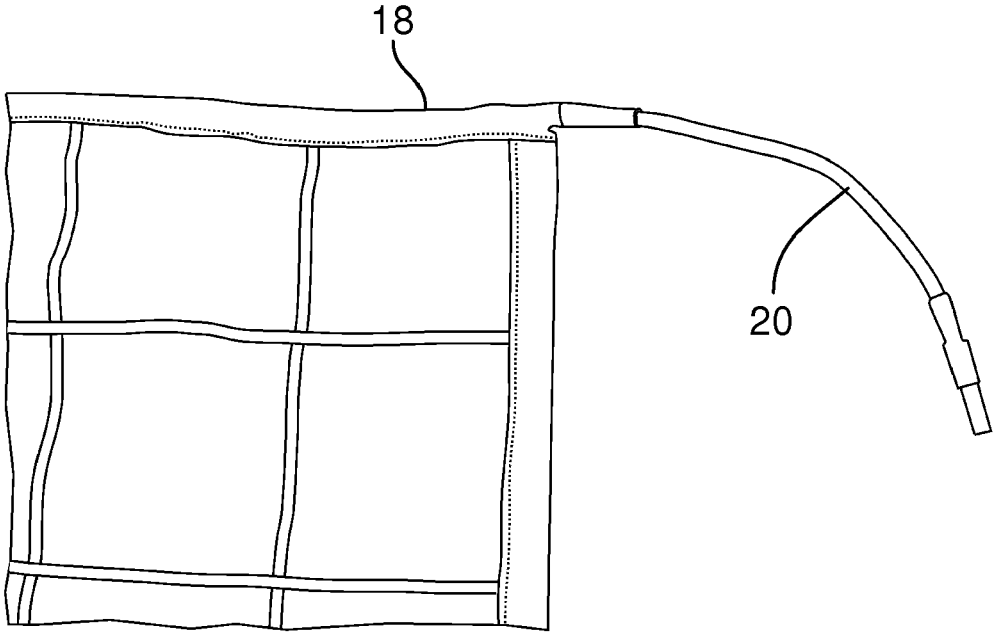
FIG. 8 shows the top edge of the mat folded over the terminal link of FIG. 7 and attached to the mat base to form a fortified top border.

FIGS. 6 and 7 show the top edge of the mat before final assembly. To complete assembly of that portion of the mat base, the base's top edge 18 is folded over the link 38 and the peripheral braid 14*a*, and over the collars 40, 42, and secured to the mat, as by sewing, to provided a fortified mat edge and connection of the terminal to the mat, as shown in FIG. 8.

In use, a worker may grip the terminal 20 when handling the mat without fear of damaging the electrical integrity of the mat by severing or otherwise damaging the mat-to-terminal connection, as the mechanical load is no longer carried entirely by the core. The casing now transfers a substantial portion, if not virtually all, of that mechanical load.

Figure 9:
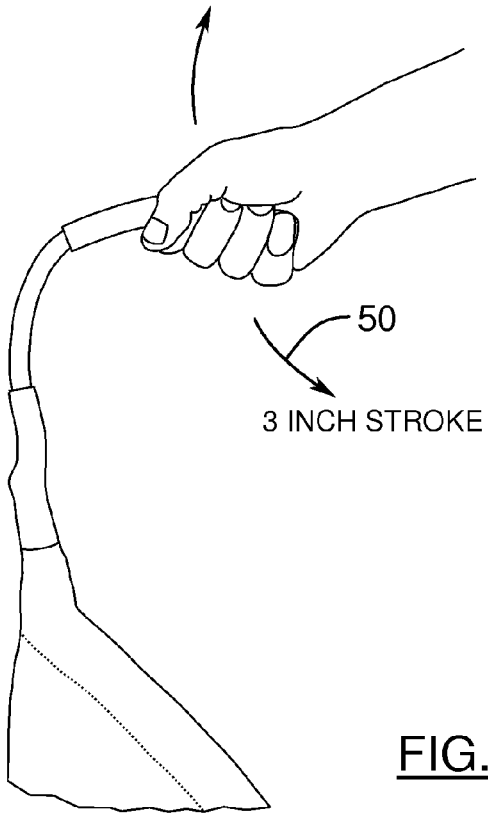
FIG. 9 illustrates a test performed on the terminal and mat of the present invention; and, FIG. 10 is a graph showing the results of that test, with a comparison to test results from a prior art mat and terminal.
Figure 10:
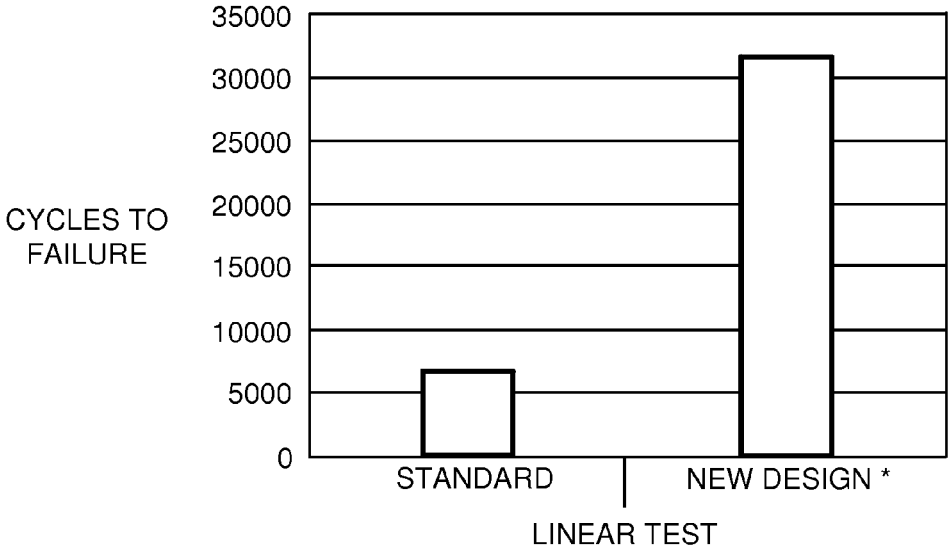

Tests were conducted to demonstrate the superior performance of the present invention over prior art mat designs. The test format is shown in FIG. 9. A given grounding mat was held up by its terminal, and a 100 lb. (about 45.5 kg) weight was suspended from the bottom of the mat. The terminal was then subjected to repeated cycles of vertical 3 inch (about 7.6 cm) strokes, indicated by arrow 50. A "standard" terminal of a prior art mat failed between 5000 and 10,000 strokes, namely at about 7000 strokes, as indicated by the left hand column of the graph in FIG. 10. However, the "new design" mat and terminal of the present invention survived beyond 30,000 strokes, namely to about 32,000 strokes, at which point the test was suspended although the terminal had not yet failed. Hence, these tests indicate that the terminal of the present design is expected to last much longer than a conventional design, and in particular appears to last at least 4 times longer, and perhaps 5 or more times longer.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

We claim:

1. An apparatus to protect a worker servicing a power source comprising a mat having:

a) a base of flexible material;

b) at least one conductive element extending over the base in a grid pattern to provide a zone of equi-potential to the worker on the base; and, c) a terminal having:

i) an elongate core in electrical communication with the conductive element for electrical load transfer with the power source to establish the zone of equipotential; and, ii) a casing extending along the core and secured to the base for mechanical load transfer with the base, and forming a grip means for the worker to move the mat.

2. The apparatus of claim 1 wherein the casing extends circumferentially about the core.

3. The apparatus of claim 1 wherein the casing comprises a flexible material of conductive, semi-conductive or insulating nature capable of providing mechanical load transfer.

4. The apparatus of claim 1 wherein the casing comprises a rigid material of conductive, semi-conductive or insulating nature capable of providing mechanical load transfer.

5. The apparatus of claim 1 wherein the core is a high ampacity tinned copper braid.

6. The apparatus of claim 1 wherein the flexible material of the base comprises a vinyl/polyester fabric.

7. The apparatus of claim 1 wherein the casing is chemically bonded to the base.

8. The apparatus of claim 1 wherein the casing is mechanically connected to the base.

9. The apparatus of claim 1 wherein at least two terminals, the core of each terminal being in electrical communication with the conductive element at opposed ends of the base.

10. The apparatus of claim 1 comprising a sleeve extending from the base and about the casing to enhance mechanical load transfer between the casing and base.

11. The apparatus of claim 10 wherein the sleeve comprises one of a heat shrink material, tie strap and cable tie.

* * * * *